US008800069B2

(12) United States Patent
Culwell

(10) Patent No.: US 8,800,069 B2
(45) Date of Patent: Aug. 12, 2014

(54) TRANSFER SEAT

(75) Inventor: Bill Culwell, Millerstown, PA (US)

(73) Assignee: Culnat, LLC., The Woodlands, TX (US)

( * ) Notice: Subject to any disclaimer, the term of this patent is extended or adjusted under 35 U.S.C. 154(b) by 1164 days.

(21) Appl. No.: 12/754,257

(22) Filed: Apr. 5, 2010

(65) Prior Publication Data

US 2010/0251472 A1 Oct. 7, 2010

Related U.S. Application Data

(60) Provisional application No. 61/166,412, filed on Apr. 3, 2009.

(51) Int. Cl.
*E03D 11/00* (2006.01)

(52) U.S. Cl.
USPC ..... 4/254

(58) Field of Classification Search
CPC ..... A61G 7/00
USPC ..... 4/254, 596, 604
See application file for complete search history.

(56) References Cited

U.S. PATENT DOCUMENTS

| | | | | |
|---|---|---|---|---|
| 2,752,610 | A | 7/1956 | Mabrey | |
| 3,209,375 | A | 10/1965 | Parsons et al. | |
| 5,433,551 | A | 7/1995 | Gordon | |
| 5,542,131 | A | 8/1996 | Brantman | |
| 5,853,166 | A | 12/1998 | Koza | |
| 6,185,759 | B1 * | 2/2001 | Staudenmayer | 4/663 |
| 2006/0179558 | A1 | 8/2006 | Dupuis | |
| 2006/0230526 | A1 | 10/2006 | Skinner | |
| 2008/0141446 | A1 * | 6/2008 | Dupuis | 4/254 |
| 2008/0222790 | A1 | 9/2008 | Grant | |
| 2008/0289099 | A1 | 11/2008 | Skinner | |

FOREIGN PATENT DOCUMENTS

| | | | |
|---|---|---|---|
| FR | 2701829 | A1 | 2/1993 |
| JP | 6108677 | A | 4/1994 |
| JP | 6335415 | A | 12/1994 |
| JP | 10001268 | A | 1/1998 |
| JP | 2000257888 | A | 9/2000 |
| JP | 2002238792 | A | 8/2002 |
| JP | 2003056021 | A | 2/2003 |
| JP | 2004057216 | A | 2/2004 |
| JP | 2005152548 | A | 6/2005 |
| JP | 2006230607 | A | 9/2006 |
| JP | 2008057310 | A | 3/2008 |

* cited by examiner

*Primary Examiner* — Lori Baker
(74) *Attorney, Agent, or Firm* — Kramer Amado P.C.

(57) ABSTRACT

A transfer seat to be used in conjunction with a toilet improves access to sanitary facilities by the disabled. The transfer seat may be used as one element of a modular system for improving bathroom fixtures designed for use by the handicapped. This modular system includes a transfer seat to be used in conjunction with a toilet; a hand rail assembly designed for use with the transfer seat; and a shower distribution system designed for use with the hand rail assembly. The components of this modular system may be used separately or together.

15 Claims, 10 Drawing Sheets

TRANSFER SEAT

BACKGROUND OF THE INVENTION

1. Field of the Invention

This invention relates generally to bathroom fixtures designed for use by the handicapped.

2. Description of Related Art

The Americans with Disabilities Act (ADA) has established standards for restrooms for use by the handicapped in commercial spaces. All restrooms, whether newly constructed or remodeled, must be usable by people with disabilities. This means at least one of each type of fixture or feature must meet handicapped requirements.

According to ADA standards, clear space measuring at least 30 inches×48 inches must be provided to accommodate a single wheelchair. A wheelchair requires at least 60 inches in diameter to make a 180 degree turn. To conserve space, a T-shaped turning space with aisles 36 inches wide allowing a three-point turn is also acceptable.

Every washroom must have at least one accessible lavatory that meets or exceeds ADA requirements. A handicapped lavatory must be set at the proper height and depth with enough clear floor space and clearance underneath to allow people in wheelchairs to easily approach and operate it. To allow a forward approach by people in wheelchairs, a clear floor space in front of the lavatory at least 30 inches wide and 48 inches deep must be provided.

All restrooms that include toilet stalls in new construction must provide at least one accessible standard compartment that complies with ADAAG requirements. A standard compartment has a minimum width of 60 inches and a length that allows using a wheelchair to approach the toilet either from the front or side. Horizontal grab bars must be mounted behind the toilet and on the nearest wall or partition. Seat heights must be 17 inches to 19 inches above the finished floor. Flush controls must be placed on the open side of the toilet with the most clear floor space and mounted no higher than 44 inches above the finished floor.

Non-commercial spaces frequently have bathroom spaces which are unable to conviently allow access by a disabled person to toilet facilities. Houses and apartments frequently have small bathrooms which do not permit a disabled person in a wheelchair to turn and approach a toilet with an unrestricted 60 inches turning radius. Additionally, houses and apartments frequently have toilets situated such that horizontal grab bars cannot be mounted on a nearby wall or partition as well as behind the toilet. For example, the toilet may not be situated in a corner.

Transfer seats for use with toilets are known which assist a handicapped individual to use a standard toilet. However, such transfer seats are generally not permanent installations; rather, they are benches which fit over a toilet and are typically moved into position when needed. However, such benches cannot be readily moved to the toilet by the handicapped person independently; accordingly, the handicapped person is still dependent on a caregiver.

Accordingly, there is a present need for a system which allows a commercial or non-commercial space to readily accommodate a handicapped individual in need of toilet facilities.

SUMMARY OF THE INVENTION

In light of the present need for improved bathroom facilities for handicapped persons which may be installed in new construction or retrofitted into old construction, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

The current document discloses a transfer seat to be used in conjunction with a toilet. The current document further discloses a modular system for improving bathroom fixtures designed for use by the handicapped. This modular system includes:

A transfer seat to be used in conjunction with a toilet;

A hand rail assembly designed for use with the transfer seat; and

A shower distribution rail designed for use with the hand rail assembly.

The components of this modular system may be used separately or together.

Various exemplary embodiments disclosed herein relate to a transfer seat assembly for use in a sanitary facility comprising a toilet having a bowl with a rim; and at least one wall adjacent to said toilet. The transfer seat assembly comprises a transfer seat adjacent to said toilet having a first end and a second end, wherein the first end of the transfer seat is secured to at least one wall of the sanitary facility; and the second end of the transfer seat is connected with the rim of the toilet. An opening in the transfer seat coincides with the bowl of the toilet; and at least one brace or leg supports the first end of the transfer seat. According to various embodiments, the opening in the transfer seat comprises a recessed lower edge which fits over the outer edge of the rim of the toilet. The toilet may further comprise a toilet seat connected to the toilet by a hinge, where the toilet seat lies within the opening in the transfer seat. An upper surface of the transfer seat and an upper surface of the toilet seat may be coplanar.

According to certain embodiments, the toilet in the sanitary facility may further comprise a lid movable between a lowered position and a raised position. The lid is hinged to at least one of the toilet seat and the transfer seat. The lid, when in the lowered position, is supported by an upper surface of the transfer seat or by an upper surface of the toilet seat. If the upper surface of the transfer seat and the upper surface of the toilet seat are coplanar, the toilet lid may be supported by both the upper surface of the transfer seat and the upper surface of the toilet seat. According to certain embodiments, the sanitary facility described herein includes a toilet and a transfer seat with an upper surface which includes comprises a non-recessed portion and a recessed portion, where the recessed portion is adjacent to the toilet. The combination of the toilet and the transfer seat has a lid which, in a lowered position, is supported by the recessed portion of the transfer seat and a toilet seat. In various embodiments, an upper surface of the lid and an upper surface of the non-recessed portion of the transfer seat are coplanar.

The foregoing embodiments are not intended to be exhaustive or limiting of the possible advantages that can be realized. Thus, these and other embodiments will be apparent from the description herein or can be learned from practicing the various embodiments, both as embodied herein or as modified in view of any variation that may be apparent to those skilled in the art. Accordingly, the present invention resides in the novel methods, arrangements, combinations, and improvements herein shown and described in various exemplary embodiments.

BRIEF DESCRIPTION OF THE DRAWINGS

In order to better understand various exemplary embodiments, reference is made to the accompanying drawings, wherein.

DESCRIPTION

Figure 1:
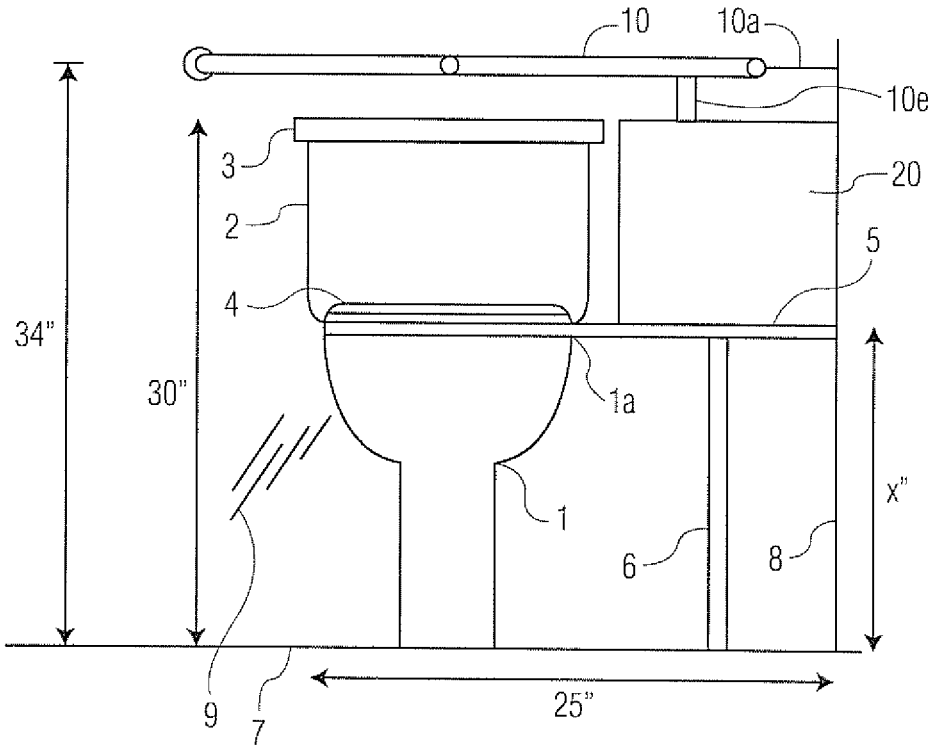
FIG. 1 shows a transfer seat used in combination with a toilet.

Referring now to the drawings, in which like numerals refer to like components or steps, there are disclosed broad aspects of various exemplary embodiments relating to a transfer seat for use with a toilet. FIG. 1 shows a front view of a toilet 1 having a tank 2, and a tank lid 3. The toilet 1 is fixed to floor 7. A transfer seat or bench 5 is fixed to the rim 1*a* of toilet 1. A toilet seat 4 is mounted by hinges to seat or bench 5 over an opening which coincides with the rim of the toilet 1. In use, a wheelchair-bound disabled individual moves from his wheelchair to the toilet lid or toilet seat 4, and then moves or slides along the transfer seat 5. To help support the weight of the disabled person, one or more braces or legs 6 may optionally be mounted between bench or transfer seat 5 and floor 7. In various exemplary embodiments, braces or legs 6 may have a fixed height corresponding to the height of the toilet. In various alternate embodiments, braces or legs 6 may have an adjustable height. This allows the installer to use standardized braces or legs having heights which can be altered to match the height of a previously installed toilet. Alternatively, as a disabled child grows, the toilet may be replaced with a higher toilet, i.e., a 12 inch toilet suitable for a three year old may be replaced with a 15 inch toilet suitable for an eight or nine year old. By making braces or legs 6 adjustable, the transfer seat and other hardware may be used with the new toilet, reducing costs associated with replacing hardware. Braces or legs 6 may be constructed with an outer member which slidably engages an inner member in a telescoping relationship. The outer member and the inner member may be releasably fixed relative to each other by a locking mechanism. Bench or transfer seat 5 may also be secured to wall 8 using a support bracket secured, preferably adjustably secured, to the wall. The transfer seat, whether assembled using braces or legs 6 or a wall support bracket, is able to withstand a weight of 250-400 pounds, preferably 350-400 pounds.

The transfer seat is set at a distance x above floor 7, where x may vary according to the needs of the user. For commercial spaces, the top of the transfer seat or bench 5 should preferably be at a distance x of about 18 to 19 inches above floor 7 in accordance with ADA (Americans with Disabilities Act) guidelines. This is about 2 to 3 inches higher than a standard toilet seat height of 16 inches. However, other heights may be used if desired for non-commercial spaces, such as home use. Height preferences for toilet seats vary considerably among disabled people. Higher seat heights may be an advantage to ambulatory disabled people, but are often a disadvantage for wheelchair users. For use by ambulatory disabled people, the transfer seat height may be as high as a distance x of about 26 inches above floor 7. On the other hand, for disabled children, a transfer seat/toilet seat height of 18 inches may be too high. For children ages 3 to 8, a toilet seat height of about 12 to 15 inches may be preferred. For children ages 9 to 12, a toilet seat height of about 15 to 17 inches may be preferred. The combined width of toilet seat 1 and transfer seat 5 may vary depending on bathroom layout, but is preferably at least 16-21 inches, as shown in FIG. 1. A grab bar 10 is mounted about four inches above the upper surface of toilet tank lid 3, and is mounted to side wall 8 and rear wall 9 by means of brackets 10*a*.

The embodiment shown in FIG. 1 shows a toilet 1 in combination with a transfer seat 5, where the combination is provided for installation as a unit. Toilet 1 and transfer seat 5 may be manufactured as a single porcelain unit, or they may be manufactured as separate units and bonded together using an epoxy resin or other structural adhesive. Transfer seat 5 may also be manufactured to cover the entire water tank to provide a complete uninterrupted transfer seat back. If toilet 1 and transfer seat 5 are manufactured as separate units, the toilet 1 is normally manufactured from porcelain, and the transfer seat 5 may be manufactured from a variety of materials. The transfer seat may be manufactured from porcelain or other ceramic materials, or from any of a range of high-strength engineering plastics, such as fiberglass, polyesters, phenolic polymers, polyamides, polyimides, polysulphones, and polyphenylene oxides. The transfer seat may also be manufactured from metal, wood, chipboard, or particle board. If the transfer seat is manufactured from chipboard or particle board, at least the front surface and the upper surface are preferably laminated with a wood, plastic, or plastic-coated paper veneer. In the embodiment shown in FIG. 1, the transfer seat is positioned between a toilet and a right hand wall. In various exemplary embodiments, the transfer seat may be positioned between a toilet and a left hand wall with equal facility. Positioning of the transfer seat relative to the toilet and an adjacent wall will depend on the personal preferences of the user, and on the geometry of the bathroom.

Figure 2:
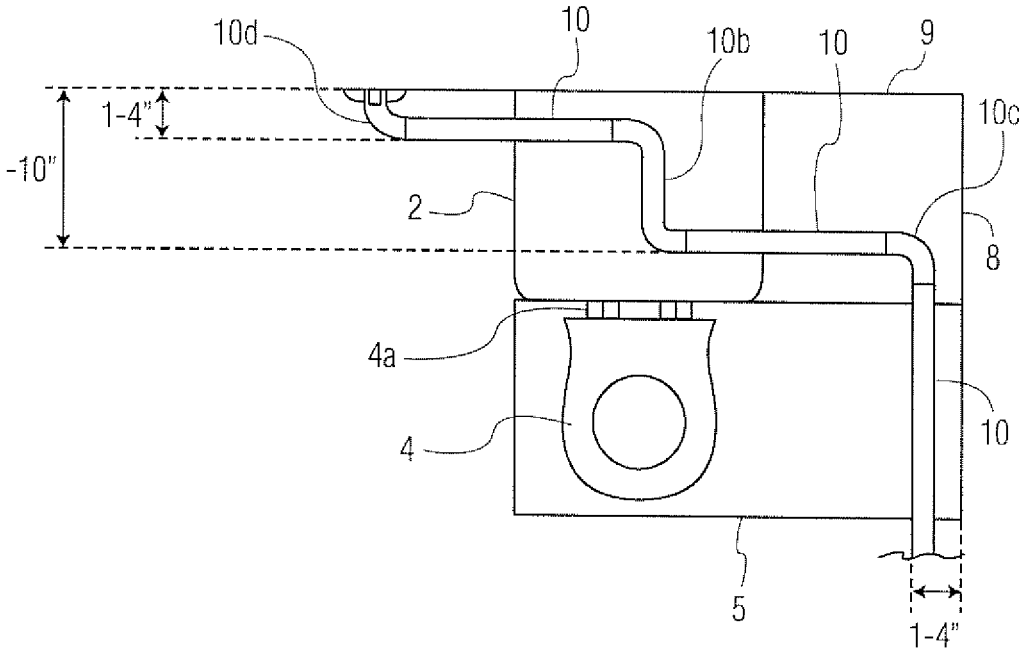
FIG. 2 provides a second view of the combination of FIG. 1.

FIG. 2 shows a top view of the embodiment shown in FIG. 1. As seen in FIG. 2, grab bar 10 contains multiple segments. Grab bar 10 contains a first segment which is parallel to rear wall 9 and is fixed between 1 and 4 inches from rear wall 9; a second segment which is parallel to rear wall 9 and is fixed between 6 and 10 inches from rear wall 9; and a third segment which is parallel to side wall 8 and is fixed between 1 and 4 inches from side wall 8. The second segment of grab bar 10 runs along wall 10 from the toilet along the back of the transfer seat, while the third segment of grab bar 10 runs along wall 8 over the end of the transfer seat. A disabled person in a wheelchair may use the second and third segments of grab bar 10 to move from a wheelchair to transfer seat 5, and then slide along transfer seat 10 to the toilet seat. The first and second segments of grab bar 10 are connected by means of S-shaped pipe 10*b*. The second and third segments of grab bar 10 are connected by means of pipe 10*c*, which is bent at a 90-degree angle. The first segment of grab bar 10 is anchored to wall 9 by fitting 10*d*. Alternatively, grab bar 10 may be formed in one continuous piece, with appropriate S- or right angle-shaped bends.

If desired, a backrest 20 may be used with the transfer seat, as seen in FIG. 1. Backrest 20 may be positioned on seat 5 adjacent to toilet tank 2. The backrest may be adhesively secured to seat 5 or to either or both of walls 8 and 9, or the backrest and the seat may be manufactured as a single element. Grab bar 10 may be mounted to backrest 20 with bracket 10*e*.

Figure 3:
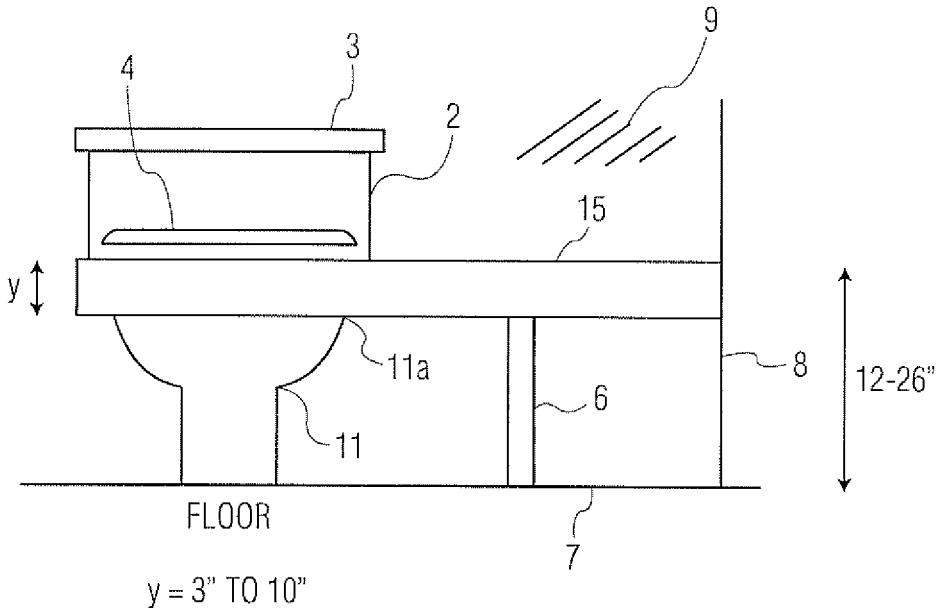
FIGS. 3 and 4 show alternate embodiments of transfer seats for use in combination with a toilet.

In various embodiments, a transfer seat 15 has a thickness y of between 1 and 3 inches, and the combined height of the toilet 1 and the transfer seat 15 will be between 12 and 26 inches, where the actual thickness of the transfer seat and toilet seat height is chosen in accordance with the preferences of a disabled user, as seen in FIG. 3. More preferably for commercial spaces, the transfer seat 15 has a thickness y of between 1 and 3 inches, and the combined height of the toilet 1 and the transfer seat 15 is between 17 and 19 inches, in accordance with ADA guidelines. The toilet tank 2 may serve as a back support, and thus should extend above the height of the transfer seat by about 10 to 15 inches.

Figure 4:
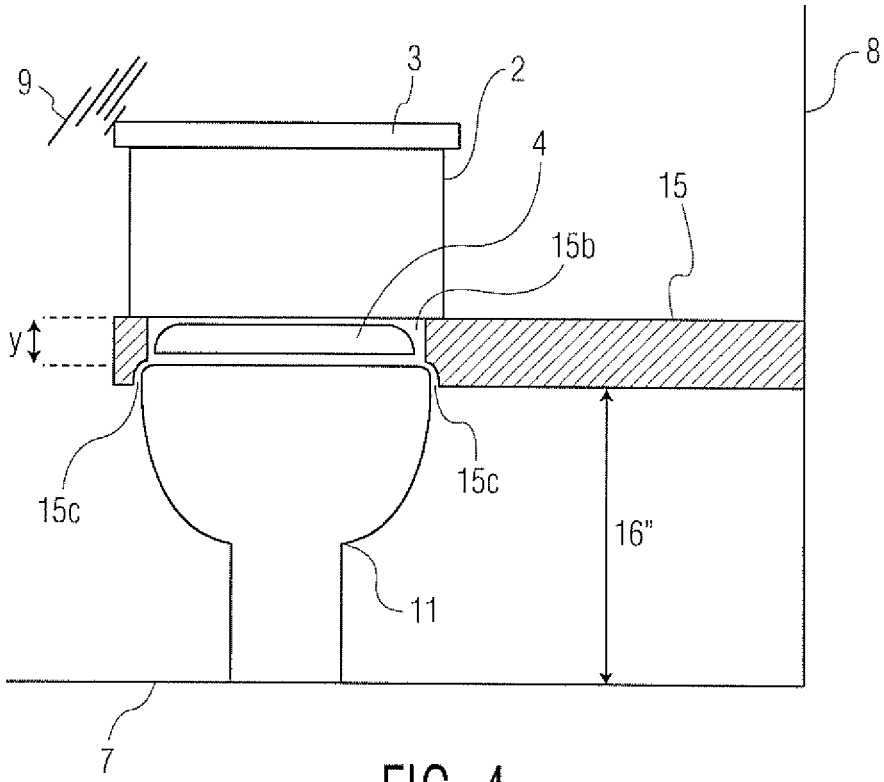

Various exemplary embodiments relate to a transfer seat adapted to be retrofitted to a standard toilet having a height of 16 inches, as seen in FIG. 4, which shows a front view of a standard toilet 11 having a height of 16 inches. Toilet 11 has a tank 2, and a tank lid 3. The toilet 11 is fixed to floor 7. A transfer seat or bench 15 is connected to the rim 11*a* of toilet 11. A toilet seat 4 may be mounted by hinges to seat or bench 15 over an opening which coincides with the rim of the toilet 11.

In various embodiments shown in FIG. 4, the transfer seat is sold separately, and is designed to be connected to an existing toilet. The transfer seat may come with an oval cutout 15*b* designed to fit over the opening to toilet 11. A recessed edge 15*c* on the underside of the cutout 15*b* in transfer seat 15 fits over the outer rim of toilet 11. This increases the stability of the transfer seat when weight is applied. This is particularly important when obese persons make use of the toilet and transfer seat. Toilet seat 4 is attached to the toilet 1 by hinges, and may be freely raised or lowered. Seat 4 may lie within the cutout 15*b* in transfer seat 15. In an exemplary embodiment, the upper surface of seat 4 is substantially coplanar with the upper surface of transfer seat 15. This allows heavy or obese patients to gain additional support for their weight from transfer seat 15 when sitting on seat 4.

The transfer seat may be manufactured as a separate unit, and sold for connection to an existing standard toilet. The transfer seat 15 may be manufactured from porcelain or other ceramic materials, or from any of a range of high-strength plastics, such as polyesters, phenolic polymers, polyamides, and polycarbonates, or from plastic materials reinforced with glass, carbon, or polyaramide fibers. The transfer seat may also be manufactured from metal, wood, chipboard, or particle board. One end of the transfer seat is preferably anchored to wall 8, or the rear edge of the transfer seat may be anchored to the wall 9 behind the transfer seat. The end of the transfer seat over the toilet may simply rest on the rim of the toilet. More preferably, the end of the transfer seat over the toilet may be fastened to the rim of the toilet by an epoxy adhesive resin or other structural adhesive.

Figure 5:
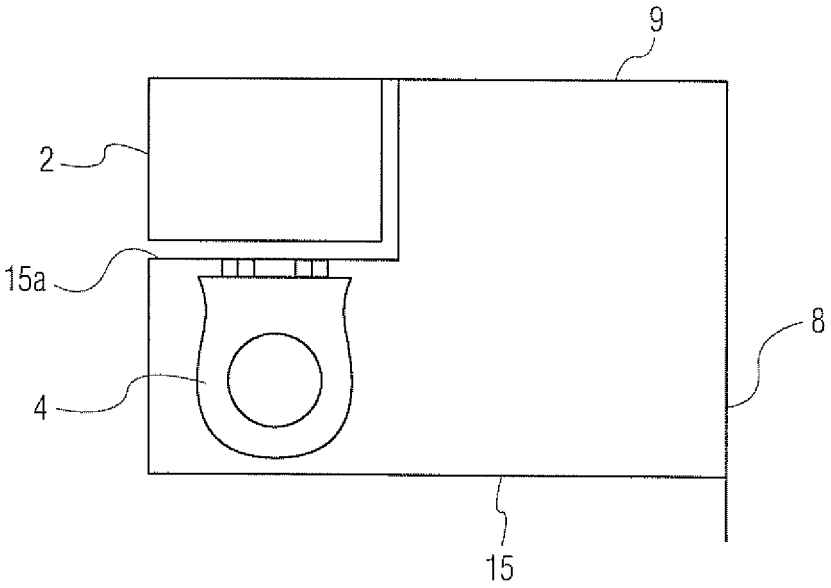
FIG. 5 shows a further embodiment of a transfer seat for use in combination with a toilet, as seen from above.

As shown in FIG. 5, the transfer seat 15 may be connected to either or both of side wall 8 and rear wall 9. A cutout portion 15*a* may be provided to accommodate toilet tank 2 on the existing standard toilet 11.

Figure 6:
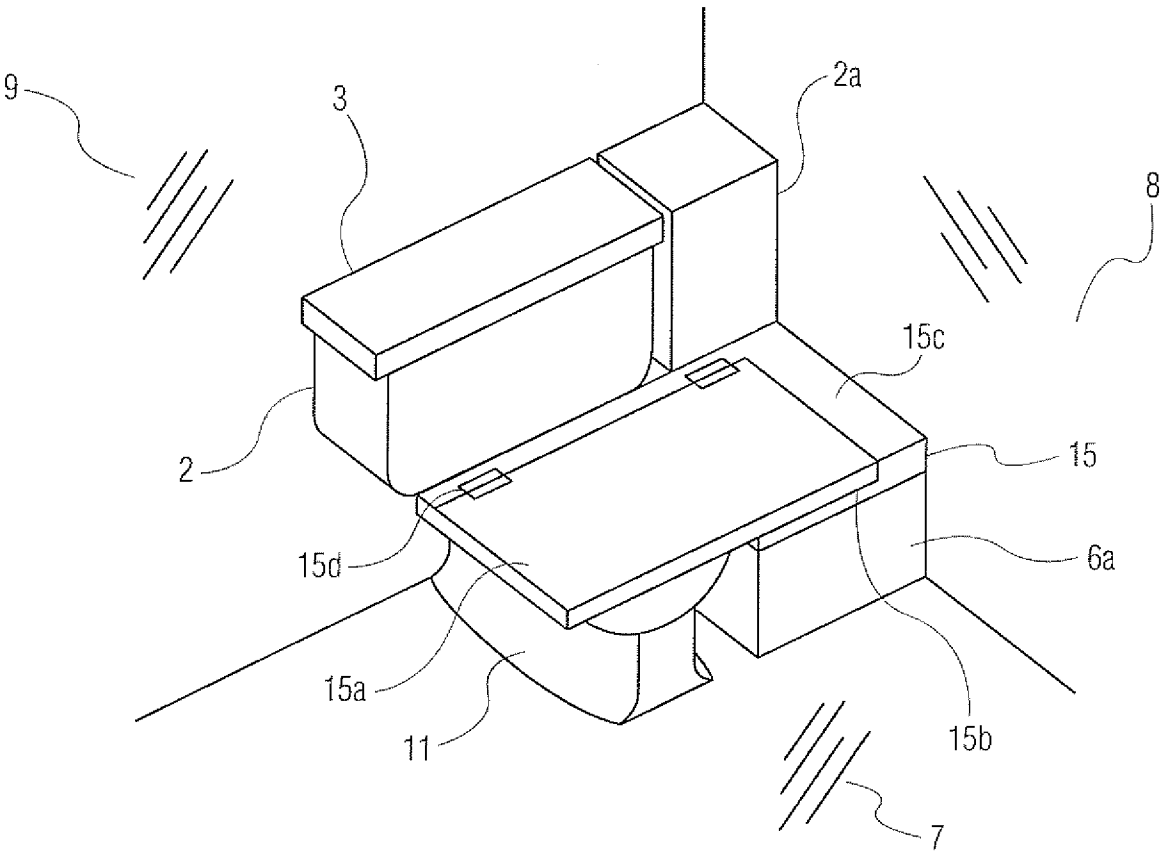
FIG. 6 shows an embodiment of a transfer seat for use in combination with a toilet, where the transfer seat comprises back and a lid.

In various embodiments, toilet 1 is mounted on floor 7 as shown in FIG. 6. The toilet tank 2 on toilet 1 is positioned against wall 9. The transfer seat 15 is manufactured as part of a unit designed to slide beside toilet 11, and be secured to at least one of walls 8 and 9 by epoxy cement or another adhesive or stainless steel screws. This unit includes base 6*a* which fits beside toilet 1, and seat 15 which is mounted on base 6*a*. Preferably, the edge of seat 15 is recessed and fits over one side of the rim of toilet 1, and is positioned so as to be adjacent to the toilet seat (not shown in FIG. 4*a*). A back support 2*a* is positioned beside toilet tank 2 to provide back support for a person sitting on the transfer seat 15. Back support 2*a*, transfer seat 15, and base 6*a* may be manufactured from plastic or porcelain or other materials as a single unit. Alternatively, back support 2*a*, transfer seat 15, and base 6*a* may be manufactured as separate units and secured in place by means of an epoxy resin or other structural adhesive.

A lid 15*a* rests on the upper surfaces of transfer seat 15 and the upper surface of the toilet seat (not shown in FIG. 4*a*), and is connected to the transfer seat by hinges 15*d*. In a lowered position, toilet lid 15*a* is supported by the upper surface of transfer seat 15 and the upper surface of seat 4. In various embodiments, toilet lid 15*a*, in a lowered position, may rest on a planar upper surface of transfer seat 15. Alternatively, toilet lid 15*a*, in a lowered position, may occupy a recessed space 15*b* formed in the upper surface of transfer seat 15, so that the upper surface of lid 15*a* is coplanar with the upper surface of a non-recessed portion of lid 15. In a raised position, toilet lid 15*a* may rest against tank 2, and serve as a back support for the patient.

Figure 7:
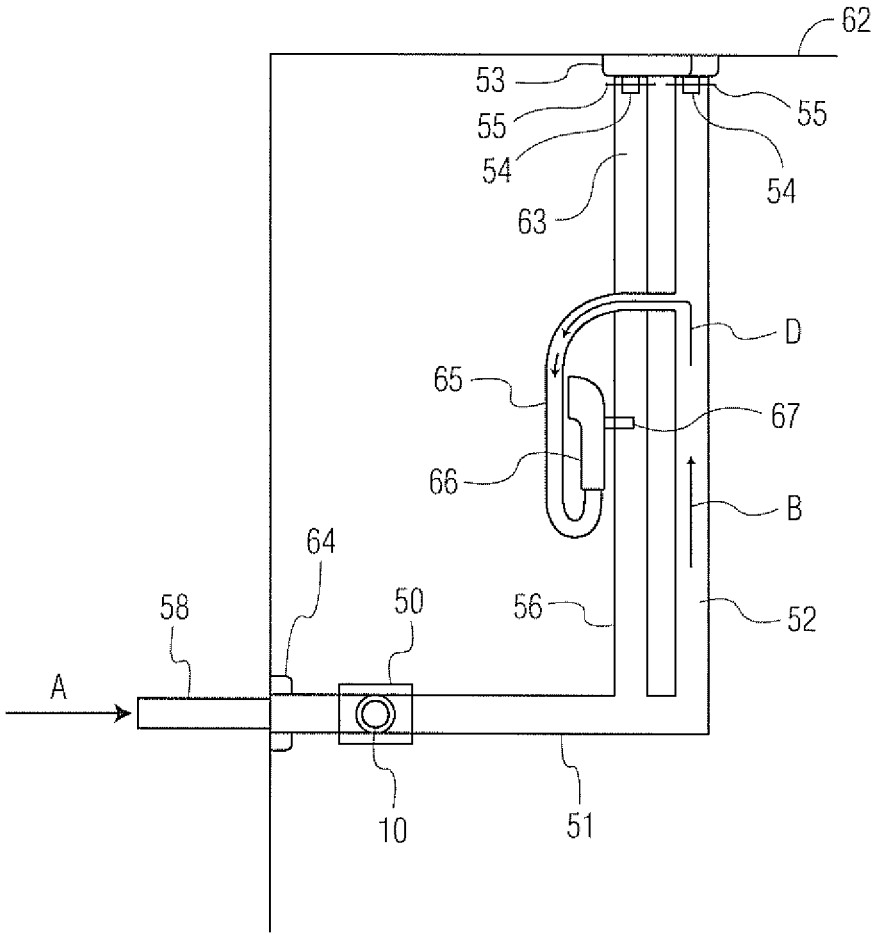
FIGS. 7, 7A, 8 and 9 show views of a shower assembly for use by disabled persons.
Figure 7A:
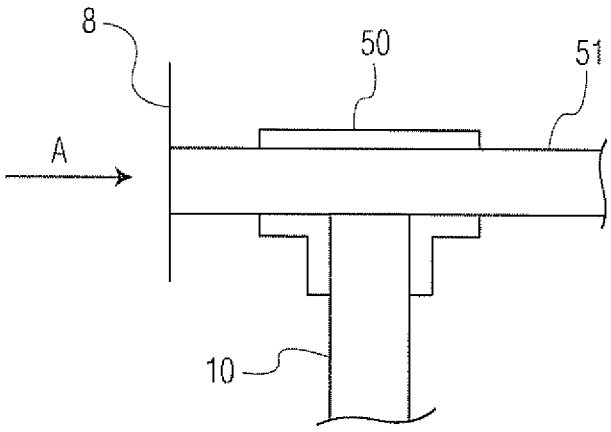

FIG. 7 shows a shower assembly to be installed in a bathroom for use by the handicapped. Grab bar 10 (seen in cross section in FIG. 7*a*) connects to a pipe 51 extending from wall 8 by a T-shaped connector 50 or by welding. T-shaped connector 50 is used to hold grab bar 10 and pipe 51 together. This connector 50 and its connections to grab bar 10 and pipe 51 are shown in more detail in FIG. 7*a*. At the end of pipe 51, a second pipe 52 extends vertically from pipe 51 to ceiling 62. Alternatively, pipe 52 may be formed by bending pipe 51 upward, creating a vertical length of pipe 52 which extends to Ceiling 62. A third pipe 56 extends downwardly from ceiling 62 to pipe 51. Pipes 52 and 56 are rigidly connected to ceiling 62. This may be done by means of appliance 53 rigidly connected to ceiling 62. Pegs 54 connected to appliance 53, fit into the upper end of pipes 52 and 56, sealing the pipes. The joint between appliance 53 and pipes 52 and 56 may then be sealed with a waterproof caulk. Additionally, the upper ends of pipes 52 and 56 may be optionally closed with a waterproof metal barrier 63. Holes are drilled through pipes 52 and 56 which coincide with holes provided in pegs 54, and screws or pegs are used to secure pipes 52 and 56 to pegs 54. Pipe 51 is anchored to wall 8 by appliance 64. The resulting assembly is able to withstand a weight of 250-400 pounds, preferably 350-400 pounds, applied to the vertical pipes 52 and 56. Thus, pipes 52 and 56 and horizontal pipe 51 are able to function as grab bars for use by disabled individuals. The grab bars may be made from stainless steel, aluminum, or plastics such as polyvinyl chloride.

Pipes 52 and 56 and horizontal pipe 51 also form part of a shower assembly. In use, water arrives through pipe 58 and flows directly or indirectly into pipe 51 in the direction of arrow A. In various exemplary embodiments, water flows directly from pipe 58 into pipe 51. Water then flows into vertical pipe 52 in the direction of arrow B. Water flows in the direction of arrow D into flexible tube 65, which is connected to pipe 52 in a conventional manner. At the end of flexible tube 65 is a handheld shower attachment 66, releasably held to one of pipes 52 and 56 by clip 67. Water may exit the assembly through showerhead 66. In various exemplary embodiments, water flows indirectly from pipe 58 into pipe 51. Pipe 58 may feed water to the interior of horizontal grab bar 10, and then from grab bar 10 to the interior of pipe 51 through an opening in the side of pipe 51.

Figure 8:
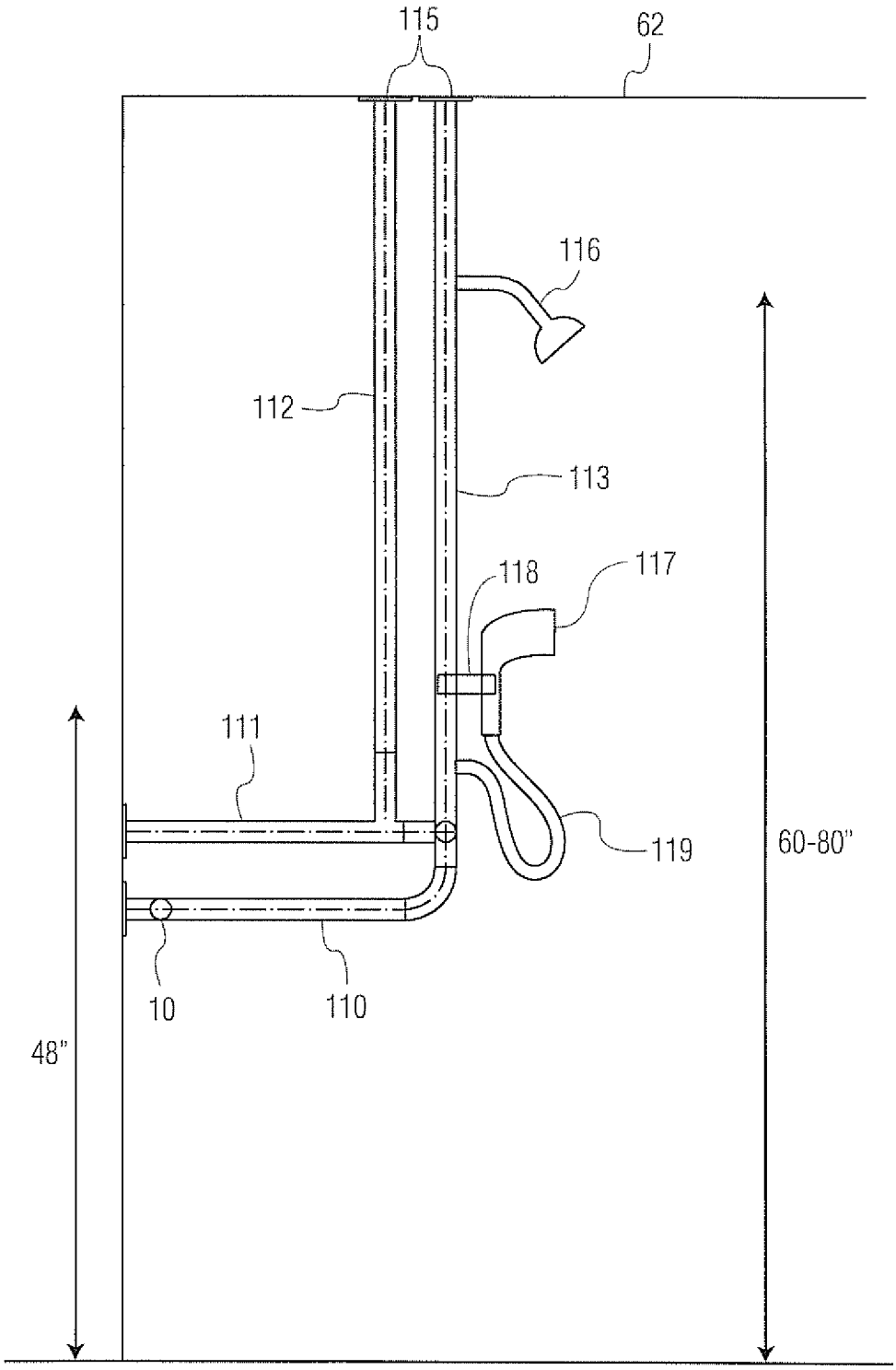

FIG. 8 shows an alternate embodiment of a shower assembly in conjunction with a grab rail. The measurements on FIG. 8 are exemplary measurements only, and are non-limiting. One end of grab bar 10 is fixed to wall 9, behind the position of a toilet/transfer seat assembly, shown in dashed lines in FIG. 8. In various exemplary embodiments, the grab bar is made of stainless steel, aluminum, or polyvinyl chloride. As shown in FIG. 8, the grab bar makes a right angle turn and extends along wall 8. Grab bar 10 is, in various exemplary embodiments, manufactured in a single unit having defined dimensions and curved. Alternatively, grab bar 10 is, in various exemplary embodiments, manufactured as multiple units having defined lengths. These units may be connected together by S-curved or right angle units. In various exemplary embodiments, section C of grab bar 10 may be lengthened or shortened, depending on the preferences of the individual and the dimensions of the bathroom. In various exemplary embodiments, section C of garb bar 10 may be eliminated. In such a situation, section D of grab bar 10 may be connected directly to wall 8.

Grab bar 10 meets horizontal pipe 110 extending from wall 8. Pipe 110 carries a stream of water. Pipe 110 intersects vertical pipe 113 at its end. Pipe 113 is fixed to the ceiling (not shown in FIG. 8), and carries a vertical flow of water from pipe 110. Grab bar 111 extends horizontally from wall 8 until it meets vertical bar 112 connected to the ceiling. Grab bar 111 then bends without leaving a horizontal plane and intersects pipe 110.

Figure 9:
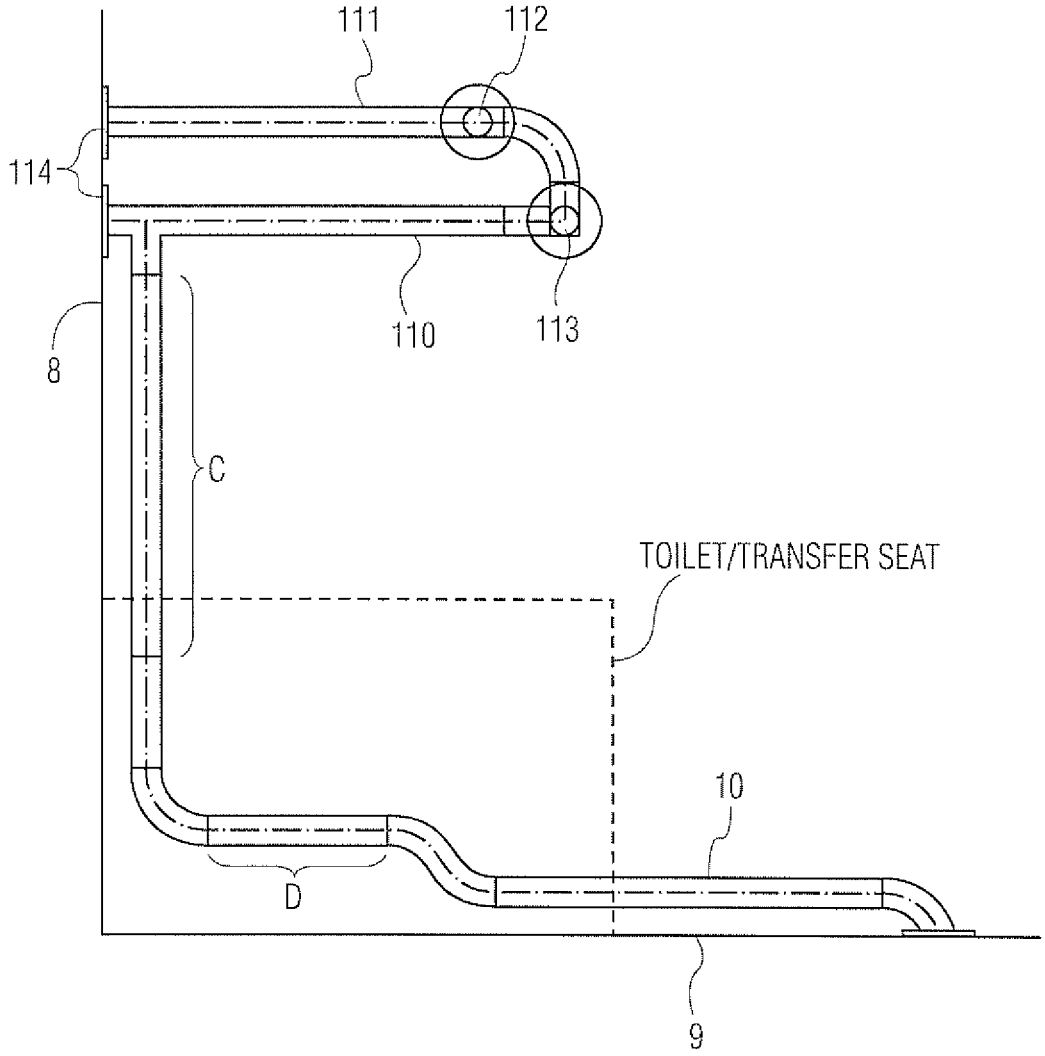

Pipe 113 and grab bar 112 are rigidly connected to the ceiling, as seen in FIG. 9, which shows section B-B of FIG. 8. This may be done by means of appliances 115 rigidly connected to ceiling 62. Pipe 110 and grab bar 111 are anchored to wall 8 by appliances 114. The resulting assembly is preferably able to withstand a weight of 250-400 pounds, preferably 350-400 pounds, applied to pipe 110 and/or grab bar 111. Thus, pipe 113 and/or grab bar 112 are able to function as grab bars for use by disabled individuals. In various exemplary embodiments, grab bars 111 and 112 do not carry water. Water enters vertical pipe 113 from horizontal pipe 110. At a height of 40 to 80, preferably 60-80, inches above the floor, a conventional showerhead 116 for use by non-disabled individuals may be installed by any means known to a person of skill in the plumbing arts.

At a height of 36-48, preferably 42 inches above the floor, a clip 118 which holds a second showerhead 117 for use by a disabled individual is connected to either pipe 113 or grab bar 112. Although showerhead 117 should be no greater than 48 inches above the floor for use by the disabled, in certain cases a lower height may be desirable. For instance, the showerhead may be installed at a lower height to ease access by disabled children. Showerhead 117 receives water from pipe 113 through flexible hose 119, which may be connected between showerhead 117 and pipe 113 by any means known to a person of skill in the plumbing arts. Diverter valves may be installed to selectively direct water flow to either of showerheads 116 and 117, where such diverter valves may be installed by any means known to a person of skill in the plumbing arts.

Figure 10:
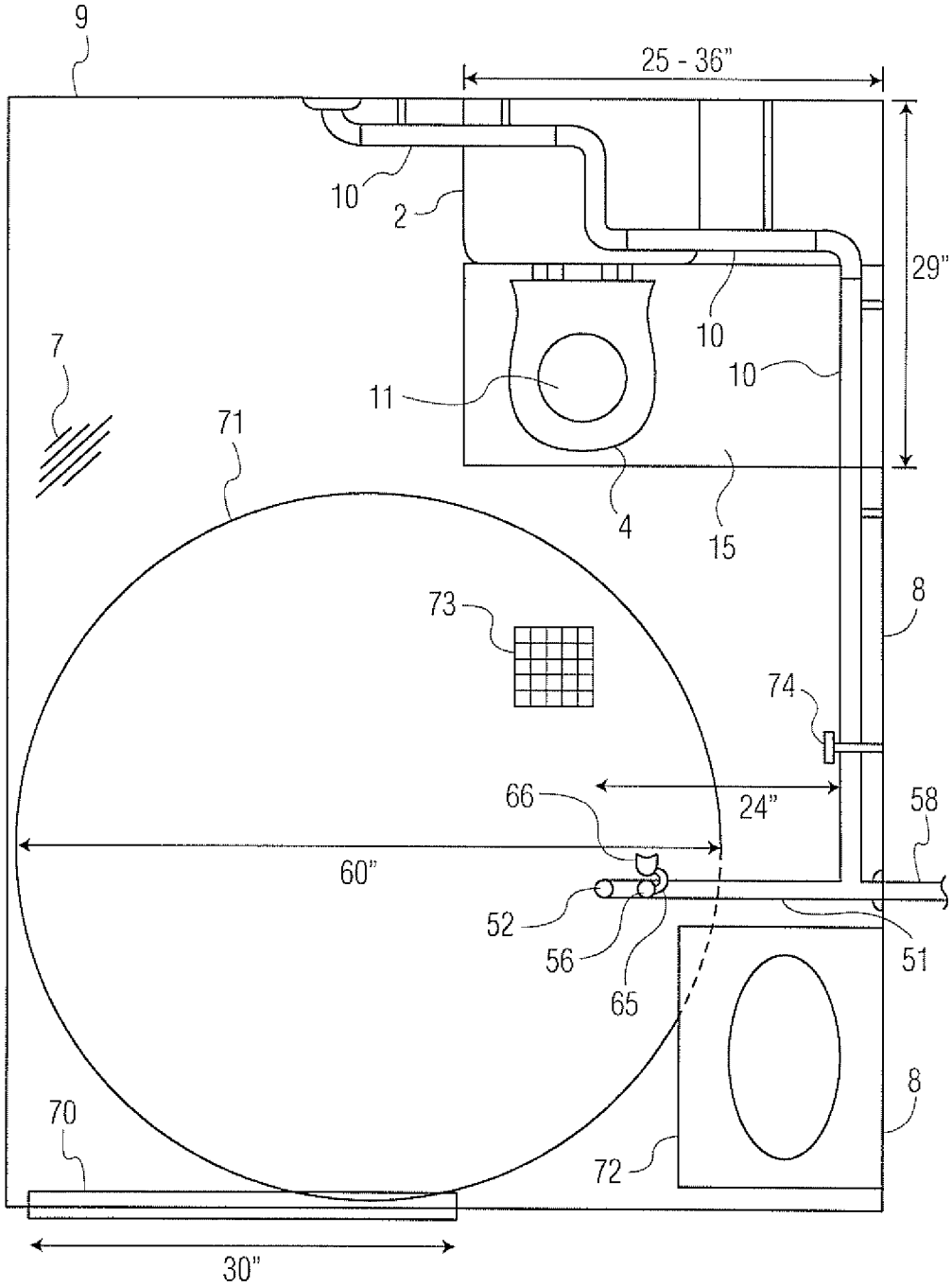
FIG. 10 shows a floor plan of a bathroom for use by disabled persons, where the bathroom includes the transfer seat used in combination with a toilet of FIG. 1 and the shower assembly of FIG. 7.

FIG. 10 offers a proposed layout for a bathroom for use by for a wheelchair-bound individual, where the dimensions of the room are about 70-90 inches wide, and 90 to 110 inches deep. The bathroom includes a sliding door 70 having a width of at least 30 inches. Inside, there is a circular space 71 having a diameter of at least 60 inches for use in turning the wheelchair 180 degrees, in accordance with ADA guidelines. A washbasin 72 is provided on side wall 8. The minimum clearance between the lower surface of the washbasin and floor 7 is 27 inches, in accordance with ADA guidelines. Along the rear wall of the room, a toilet 1 is placed. Transfer seat 15 is positioned on or around the rim of toilet 1 and extends to wall 8. The distance between the front edge of transfer seat 5 and wall 9 is 29 inches. The total width of the transfer seat in combination with the toilet is typically 25 to 36 inches, although the width of the transfer seat may vary outside of this range depending on the space available and the preferences of the user. Grab bar 10 runs along wall 9 behind the transfer seat. As discussed previously, grab bar 10 then bends 90 degrees and runs along wall 8. The wheelchair-bound individual may then maneuver his wheelchair adjacent to the transfer seat, grab hold of the portion of grab bar 10 running parallel to wall 8, and use this portion of the grab bar to assist in transferring from the wheelchair to the transfer seat 15. He may then grab hold of the portion of grab bar 10 running parallel to wall 9 behind the transfer seat, and use this to assist in pulling himself along the transfer seat and onto the toilet seat 4. The grab bar 10 is preferably at least 34 inches above floor 7. The length of each linear portion of grab bar 10 may be individually adjusted to fit the dimensions of the room and the needs of the user. This allows increased flexibility in bathroom design, as the user is not restricted to the use of grab bars of fixed lengths.

As shown in FIG. 10, the bathroom has a shower facility comprising pipes 51, 52 and 56, flexible tube 65, and handheld shower attachment 66, substantially as shown in FIG. 7. Shower controls 74 are mounted on the wall, between pipe 51 and transfer seat 15. A drain 73 is positioned in the bathroom floor 7. Bathroom floor 7 preferably slopes downwardly from the bathroom walls toward drain 73.

The shower assembly may also be used independently of the transfer bench assembly. This creates a roll in shower, whereby user can bathe with the aid of a specially designed chair designed for that purpose. The resulting layout offers a large empty space adjacent to one wall, with a proper turning radius for a wheelchair.

Figure 11A:
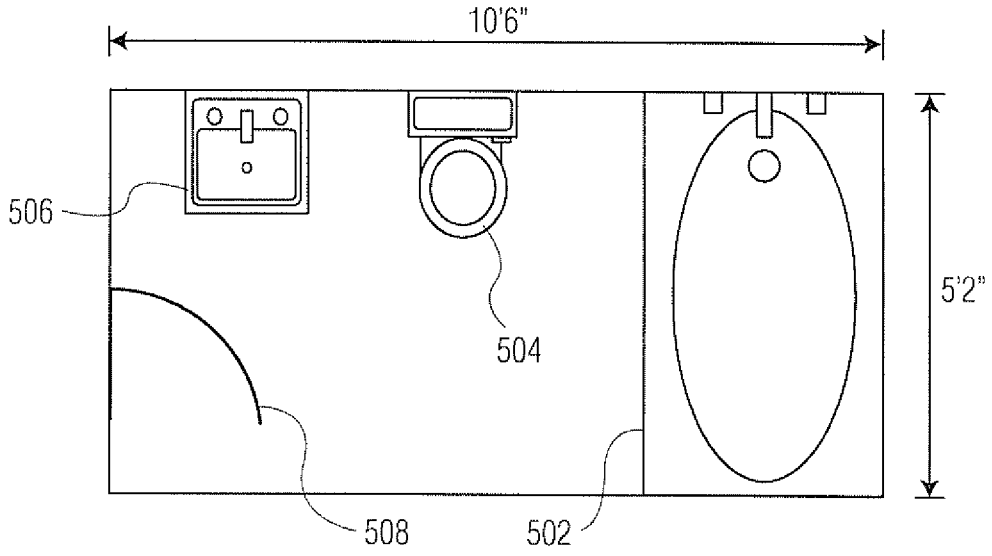
FIGS. 11A and 11B show use of a transfer seat of FIG. 1 to modify a bathroom layout of to increase access to toilet facilities for handicapped persons.
Figure 11B:
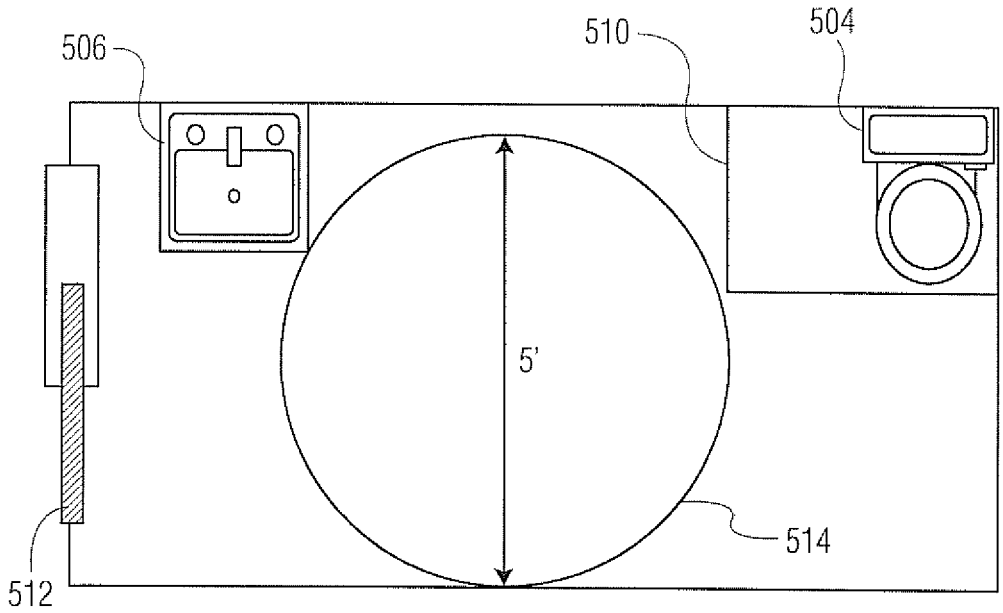

FIG. 11*a* shows an inaccessible bathroom having a width of 5 feet 2 inches, with a bathtub/shower 502, toilet 504, and basin 506 arranged so that no unobstructed 60-inch wheelchair turning radius exists. The presence of a hinged door 508 which opens inward only compounds the problem. A solution is presented in FIG. 11*b*, where the bathtub/shower 502 has been removed. The toilet 504 has been replaced by a combination of a toilet 504 and transfer seat 510 installed in a portion of the space occupied by the tub. Replacement of the hinged door 508 by a sliding door 512 further increases accessibility. As a result, an unobstructed 60-inch wheelchair turning radius 514 exists. A shower distribution rail in accordance with FIG. 10 is unnecessary to achieve accessibility.

Figure 12:
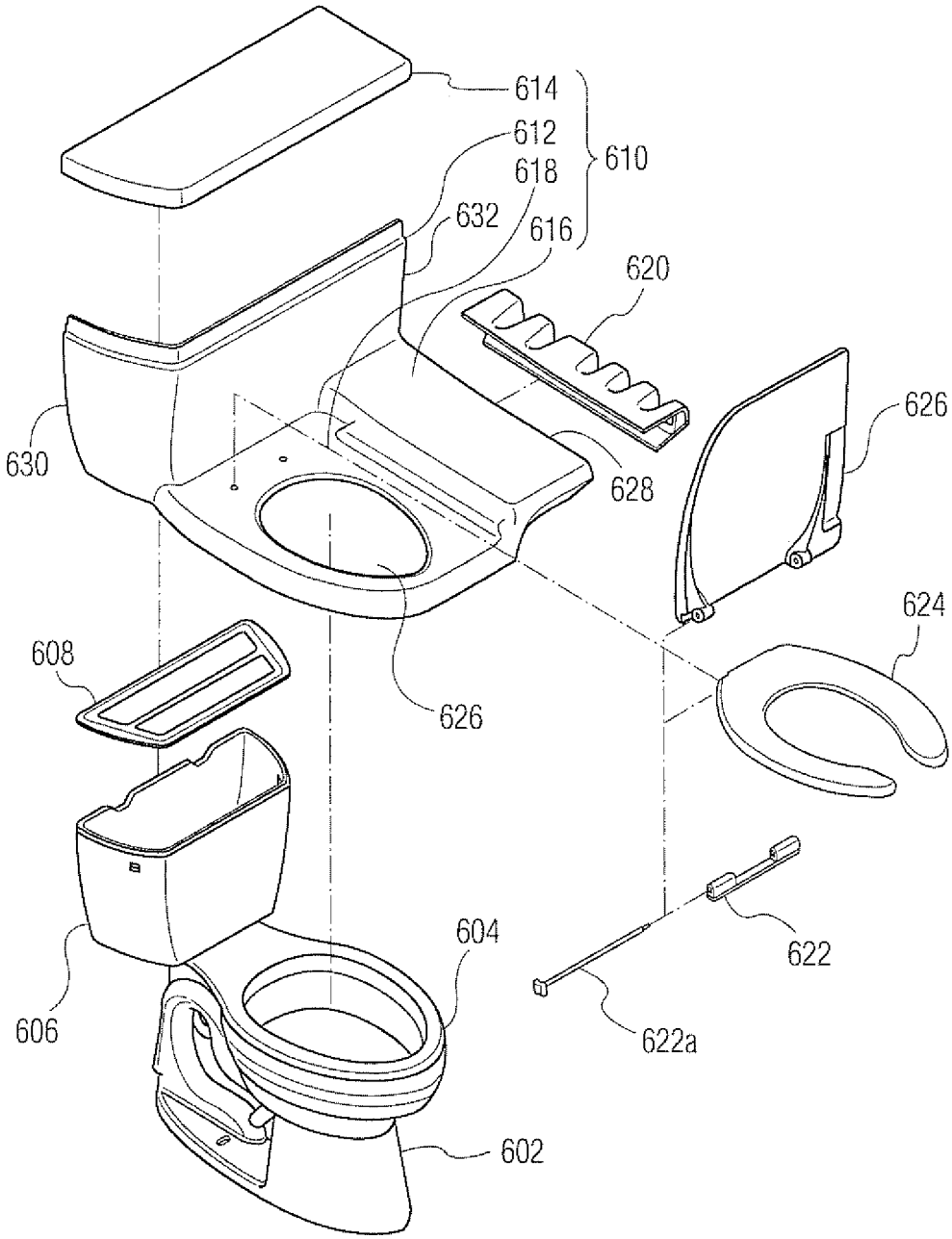
FIG. 12 show shows a further embodiment of a transfer seat for use in combination with a toilet.

A further embodiment of a transfer seat 610 is shown in FIG. 12. The transfer seat 610 is mounted on a toilet 602 having a bowl with a rim 604. The toilet has a tank 606 with a lid 608. The transfer seat 610 includes a seat portion including a first seat portion 618 and a second seat portion 616, each of seat portions 616 and 618 having an upper surface. The upper surface of seat portion 618 is depressed relative to the surface of seat portion 616. Seat portion 618 has an oval cutout 626 which fits over rim 604 of toilet 602. If desired, a lower surface of seat portion 618 may have an indented portion (not shown in FIG. 12) along the edge of cutout 626 into which rim 604 fits. A shell 612 of transfer seat 610 encloses toilet tank 606 when the transfer seat is positioned over toilet 602. Shell 612 has a first end 632 which may be adhesively secured by an epoxy cement or other adhesive to a first wall adjacent to toilet 602, if desired. Shell 612 has a second end 630 which may be adhesively secured by an epoxy cement or other adhesive to a second wall behind toilet 602. This holds the transfer seat in position, relative to the toilet. Shell 612 of transfer seat 610 has an open top to allow access to toilet tank 606, but may be covered with lid 614 if desired. An end 628 of seat portion 616 may be secured to an adjacent wall by an adhesive or epoxy cement. However, it is preferred to secure end 628 of seat portion 616 to an adjacent wall by means of brace 620. Brace 620 is secured to the adjacent wall by means of mechanical fasteners, such as, for example, screws or nails. End 628 of seat portion 616 then slides into the open end of brace 620. Connection of seat portion 616 to the wall by means of brace 620 holds the transfer seat in position with greater strength than a connection by means of adhesive.

A hinge 622 is then attached to seat portion 618 of transfer seat 610. Toilet seat 624 and toilet lid 626 are fitted to hinge 622, and pin 622*a* is used to secure toilet seat 624 and toilet lid 626 to hinge 622.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

A further embodiment of a transfer seat 610 is shown in FIG. 12. The transfer seat 610 is mounted on a toilet 602 having a bowl with a rim 604. The toilet has a tank 606 with a lid 608. The transfer seat 610 includes a seat portion including a first seat portion 618 and a second seat portion 616, each of seat portions 616 and 618 having an upper surface. The upper surface of seat portion 618 is depressed relative to the surface of seat portion 616. Seat portion 618 has an oval cutout 626 which fits over rim 604 of toilet 602. If desired, a lower surface of seat portion 618 may have an indented portion (not shown in FIG. 12) along the edge of cutout 626 into which rim 604 fits. A shell 612 of transfer seat 610 encloses toilet tank 606 when the transfer seat is positioned over toilet 602. Shell 612 has a first end 632 which may be adhesively secured by an epoxy cement or other adhesive to a first wall adjacent to toilet 602, if desired. Shell 612 has a second end 630 which may be adhesively secured by an epoxy cement or other adhesive to a second wall behind toilet 602. This holds the transfer seat in position, relative to the toilet. Shell 612 of transfer seat 610 has an open top to allow access to toilet tank 606, but may be covered with lid 614 if desired. An end 628 of seat portion 616 may be secured to an adjacent wall by an adhesive or epoxy cement. However, it is preferred to secure end 628 of seat portion 616 to an adjacent wall by means of brace 620. Brace 620 is secured to the adjacent wall by means of mechanical fasteners, such as screws or nails. End 628 of seat portion 616 then slides into the open end of brace 620. Connection of seat portion 616 to the wall by means of brace 620 holds the transfer seat in position with greater strength than a connection by means of adhesive.

A hinge 622 is then attached to seat portion 618 of transfer seat 610. Toilet seat 624 and toilet lid 626 are fitted to hinge 622, and pin 622*a* is used to secure toilet seat 624 and toilet lid 626 to hinge 622.

What is claimed is:

1. A transfer seat assembly for use in a sanitary facility comprising a toilet having a bowl with a rim; and at least one wall adjacent to said toilet, said transfer seat assembly comprising:

a transfer seat adjacent to said toilet having a first end and a second end, wherein said first end of said transfer seat is secured to at least one wall of said sanitary facility, and said second end of said transfer seat is connected with said rim of said toilet; and an opening in said transfer seat which coincides with said bowl of said toilet, wherein said opening in said transfer seat comprises a recessed lower edge which fits over the outer edge of the rim of said toilet.

2. A transfer seat assembly according to claim 1, wherein said toilet further comprises a toilet seat connected to said toilet by a hinge, wherein said toilet seat lies within said opening in said transfer seat.

3. A transfer seat assembly according to claim 2, wherein an upper surface of said transfer seat and an upper surface of said toilet seat are coplanar.

4. A transfer seat assembly according to claim 2, wherein said toilet further comprises a lid movable between a lowered position and a raised position, wherein said lid in said lowered position is supported by said transfer seat and said toilet seat.

5. A transfer seat assembly according to claim 4, wherein said lid in said lowered position is supported by said transfer seat and said toilet seat, wherein an upper surface of said transfer seat and an upper surface of said toilet seat are coplanar.

6. A transfer seat assembly according to claim 4, wherein an upper surface of said transfer seat comprises a non-recessed portion and a recessed portion, said recessed portion being adjacent said toilet, and said lid in said lowered position is supported by said recessed portion of said transfer seat and said toilet seat, wherein an upper surface of said lid and an upper surface of said non-recessed portion are coplanar.

7. A transfer seat assembly according to claim 4, wherein said transfer seat is made of a material selected from the group consisting of porcelain, wood, metal, chipboard, particle board, or a polymeric material.

8. A transfer seat assembly according to claim 7, wherein said transfer seat is made of a polymeric material selected from the group consisting of a polyester, a phenolic polymer, a polyamide, or a polycarbonate, said plastic material being reinforced with glass fibers, carbon fibers, or polyaramide fibers.

9. In a transfer seat assembly comprising a toilet having a bowl with a rim, a toilet seat connected to said bowl by hinges, and a toilet tank; a first wall adjacent to said toilet, a back of said toilet tank being positioned against said first wall; and a second wall perpendicular to said first wall, the improvement comprising:

a transfer seat assembly adjacent to said toilet having a first end and a second end, wherein said transfer seat assembly comprises:

a base mounted adjacent to said toilet, said base being secured to at least one of said first and second walls;

a transfer seat mounted on said base, said transfer seat having at least one edge which fits over said rim of said toilet;

a lid connected to said transfer seat by hinges, wherein said lid may be moved from a raised position to a lowered position, wherein in said lowered position said lid rests on an upper surface of said toilet seat and at least a portion of an upper surface of said transfer seat; and a back support adjacent to said toilet tank, said back support being connected with said transfer seat.

10. The combination of a toilet and a transfer seat, said toilet being rigidly connected to a floor, wherein:

said toilet includes a bowl with a rim, and a toilet seat connected to said bowl by hinges; and said transfer seat includes a first end, a second end, and at least one support rigidly connected with said floor, wherein said first end of said transfer seat is connected with said rim of said toilet, and an opening in said transfer seat coincides with said bowl of said toilet, wherein said transfer seat further includes a lid connected to said transfer seat by hinges, said lid being movable between a raised position and a lowered position, so that when said lid is in the lowered position, said lid is supported on said toilet seat and at least a portion of an upper surface of said transfer seat.

11. A transfer seat assembly for use with a toilet having a rim and a bowl, said transfer seat assembly comprising:

a transfer seat including a first end and a second end, and at least one support rigidly connected with a floor or a side wall, wherein said first end of said transfer seat is adapted to be connected with said rim of said toilet, wherein said first end of said transfer seat comprises a recessed lower surface which rests on at least a portion of said rim of said toilet.

12. The transfer seat according to claim 11, wherein said first end of said transfer seat comprises an opening that coincides with said bowl of said toilet.

13. The transfer seat according to claim 11, wherein said first end of said transfer seat comprises an opening that coincides with said bowl of said toilet, said opening having a depressed lower edge that rests on said rim of said toilet.

14. A transfer seat assembly according to claim 1, further comprising a leg supporting said first end of said transfer seat.

15. A transfer seat assembly according to claim 1, further comprising a brace connected to a wall and supporting said first end of said transfer seat.

* * * * *